US007096893B2

(12) United States Patent
Vilalta et al.

(10) Patent No.: US 7,096,893 B2
(45) Date of Patent: Aug. 29, 2006

(54) FOOD STORAGE CONTAINERS

(75) Inventors: Montserrat Vilalta, Barcelona (ES); Jose Millan, Barcelona (ES); Juan Carlos Coronado, Barcelona (ES); Mariano Penaranda, Barcelona (ES); Antonio Rebordosa, Barcelona (ES)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 10/457,319

(22) Filed: Jun. 9, 2003

(65) Prior Publication Data

US 2004/0040618 A1 Mar. 4, 2004

Related U.S. Application Data

(63) Continuation-in-part of application No. PCT/EP01/13234, filed on Nov. 15, 2001, and a continuation-in-part of application No. PCT/EP01/13147, filed on Nov. 14, 2001.

(30) Foreign Application Priority Data

Dec. 8, 2000 (DE) ..... 100 60 996
Dec. 8, 2000 (DE) ..... 100 60 998

(51) Int. Cl.
*B65B 1/04* (2006.01)

(52) U.S. Cl. ..... 141/65; 141/8; 99/472

(58) Field of Classification Search ..... 141/4, 141/7, 8, 65; 99/472, 646 C; 206/524.8; 215/260, 215/262; 220/231; 417/239, 437, 550
See application file for complete search history.

(56) References Cited

U.S. PATENT DOCUMENTS

| | | | | |
|---|---|---|---|---|
| 2,130,180 A | | 9/1938 | Evans | |
| 2,634,014 A | | 4/1953 | Kimber | |
| 2,655,894 A | | 10/1953 | Milton | |
| 3,241,514 A | | 3/1966 | Grimland | |
| 3,737,066 A | | 6/1973 | Ames | |
| 4,016,999 A | | 4/1977 | Denzer | |
| 4,051,971 A | * | 10/1977 | Saleri et al. | 215/260 |
| 4,674,642 A | | 6/1987 | Towns et al. | |
| 4,793,717 A | | 12/1988 | Manske | |
| 4,838,772 A | | 6/1989 | LeBlanc | |
| 5,137,424 A | * | 8/1992 | Daniel | 415/206 |
| 5,195,427 A | * | 3/1993 | Germano | 99/472 |
| 5,277,876 A | | 1/1994 | Wagner | |
| 5,279,550 A | | 1/1994 | Habib et al. | |
| 5,465,857 A | | 11/1995 | Yang | |
| 5,735,317 A | | 4/1998 | Wu | |
| 5,762,228 A | | 6/1998 | Morgan et al. | |
| 5,779,082 A | | 7/1998 | Miramon | |
| 5,762,282 A | | 9/1998 | Chen et al. | |
| 5,806,703 A | | 9/1998 | Grandi | |
| 5,955,127 A | | 9/1999 | Glaser | |
| 5,974,686 A | | 11/1999 | Nomura et al. | |
| 6,799,506 B1 | * | 10/2004 | Tarlow | 99/472 |
| 2004/0173105 A1 | | 9/2004 | Kim et al. | |

FOREIGN PATENT DOCUMENTS

| | | |
|---|---|---|
| CH | 304374 | 3/1955 |
| DE | 7409380 | 3/1974 |
| DE | 2821852 A1 | 5/1978 |

(Continued)

*Primary Examiner*—Timothy L. Maust
(74) *Attorney, Agent, or Firm*—Fish & Richardson P.C.

(57) ABSTRACT

A food storage container includes a lid with a vent hole, and a removable cover removably secured to the lid to cover the vent hole. The cover has an evacuation hole. The food storage container further includes a one-way air valve disposed between the vent hole and evacuation hole. With the cover secured to the lid, the one-way air valve inhibits air flow into the container through the vent hole while allowing air flow out of the container via the vent hole and evacuation hole. With the cover removed, the one-way air valve allows bi-directional air flow through the vent hole. An outer surface of the cover defines a smooth sealing area extending about the evacuation hole for sealing against a vacuum pump held against the cover over the evacuation hole to evacuate the container.

17 Claims, 12 Drawing Sheets

FOREIGN PATENT DOCUMENTS

| | | | |
|---|---|---|---|
| DE | 83 2 1236 | | 7/1983 |
| DE | 4136150 | A1 | 11/1991 |
| DE | 43 06 171 | | 2/1993 |
| DE | 4334250 | A1 | 10/1993 |
| DE | 43 42 394 | | 12/1993 |
| DE | 19504638 | A1 | 2/1995 |
| DE | 29920316 | U1 | 11/1999 |
| DE | 10 060 998 | | 12/2000 |
| DE | 10 060 999 | | 12/2000 |
| EP | 0234607 | | 9/1987 |
| EP | 0633196 | A2 | 1/1995 |
| EP | 0644128 | A1 | 3/1995 |
| EP | 0820939 | A1 | 1/1998 |
| FR | 2 235 064 | | 6/1973 |
| FR | 2 692 870 | | 6/1992 |
| GB | 2 317 882 | | 4/1998 |
| JP | 07277374 | | 10/1995 |
| RU | 2 089 087 | | 9/1997 |
| WO | WO88/00560 | | 1/1988 |
| WO | WO91/08151 | | 6/1991 |
| WO | WO97/17259 | | 5/1997 |
| WO | WO02/46057 | | 6/2002 |

* cited by examiner

FOOD STORAGE CONTAINERS

CROSS-REFERENCE TO RELATED APPLICATIONS

This application is a continuation-in-part of PCT applications PCT/EP01/13147, filed on Nov. 14, 2001, and PCT/EP01/13234, filed on Nov. 15, 2001, and claims priority under 35 U.S.C. § 119(a) from German patent applications DE 100 60 998.8 and DE 100 60 996.1, both filed on Dec. 8, 2000.

TECHNICAL FIELD

This invention relates to sealable food storage containers.

BACKGROUND

Food storage systems can allow food to be preserved under better conditions than if the food were stored without such systems. One way to improve the storage of food is to keep it in a container under vacuum. Such systems have been shown to produce very good results in protecting food from certain microorganisms, pests, mold and fungus growth. Furthermore, they help to prevent the food from oxidizing, maintaining the moisture level and aroma of the food.

Lids for storage containers can include a venting or aerating valve for the equalization of pressure during heating in a microwave oven.

EP 0 633 196 A2 describes such a lid. The objective of EP 0 633 196 A2 is to prevent the build-up of overpressure in the interiors of food storage containers that are heated in a microwave oven. The build-up of overpressure tends to occur when there are aqueous liquids in a container interior. The liquids can evaporate during heating, thereby building up an overpressure in the interior of the container. This is a disadvantage particularly when opening the container lid because it can cause sauces or other food items to spurt out suddenly when the lid is opened. EP 0 633 196 A2 proposes a venting valve in the lid of the food storage container. The venting valve is to be opened before the container is placed in the microwave oven. Water vapor developing during the heating operation can then escape unhindered through the valve without a corresponding build-up of vapor pressure in the interior of the sealed container.

The objective of EP 0 820 939 A1 also is the prevention of the build-up of overpressure in the interiors of food storage containers that are heated in a microwave oven. In other words, the objective is to provide food storage containers with venting capability, in order to be able to safely heat in a microwave oven the food stored inside of the containers, with the container lid closed. Unlike EP 0 633 196 A2, a valve mechanism is described which can be opened by way of a joint like a rocker. Hence all that is required is to press in the rocker lever for the valve to open with ease.

WO 88/00560 describes an opening mechanism for a plastic beverage can. By opening a venting valve, the pressure can be equalized, thereby making it easier to subsequently open and pull off the entire lid. The lids in WO 88/00560 invariably are plastic lids, because an objective is to avoid the use of metal lids. In particular, the equalization of overpressure in the interior of the container resulting from carbonated beverages, for example, plays a role in this case.

Further, U.S. Pat. No. 3,737,066 discloses a container devised preferably for the storage of liquids. The side walls of the container are made of a coated carton material, and the base and lid elements of the container are comprised of plastic plates connected with the carton walls in a liquid-tight relationship. The upper plastic lid has a reclosable opening mechanism which is also made of plastic and is positively engaged with the lid by holding pins. No provision is made for venting prior to opening the container lid or for a device for pressure equalization.

CH 304 374 discloses a closure lid for an aluminum sterilizing container. The lid has an essentially circular-ring-shaped configuration, and it is mounted on a cylindrical aluminum container. A rubber seal is placed between the edge of the lid and the upper brim of the container. Provided in the middle of the container lid is an additional opening which is covered by a rubber cap. The rubber cap provides a visual check, indicating whether there is a vacuum inside the container. As long as the pressure inside the container is adequately below atmospheric pressure, the rubber cap bulges inward a corresponding amount. This bulge diminishes continually as the vacuum decreases. Hence it is difficult for the observer to decide whether the pressure level inside the container is adequate for ensuring the freshness of the food inside the container.

U.S. Pat. No. 5,195,427 and WO 97/17259 both describe vacuum pumps for evacuating food storage containers. In each specification, conically extending suction tips are inserted in corresponding valve openings in storage container lid.

EP 0 234 607 B1 describes a bottle closure which also serves as a vent valve. A cylindrical vacuum pump is connected thereto, such that it fully encompasses the projecting cylindrical shank of the bottle closure.

EP 0 644 128 A1 describes a sealable container adapted to be evacuated by a vacuum pump. A one-way valve is received in a cylindrical recess in the container lid, and the suction opening of a vacuum pump is inserted therein.

In DE-74 09 380 U, a food storage container includes a filling opening which is closable by a lid. At its center, the lid has a vent opening which is closable by a valve element. The valve element has an opening lug which allows the valve element to be lifted off the vent opening, thus enabling the vacuum existing inside the storage container to be reduced. After cooking, a vacuum can be obtained in the storage container by allowing the food to cool with the valve closed.

Furthermore, in DE-28 21 852 A1, a food storage container is closable air-tight by a lid equipped with a valve. The valve is arranged at the center of the lid and is surrounded by an annular connecting device on which a vacuum pump for venting the food space of the storage container is mountable. To open the storage container, the valve disk has to be lifted off the sealing edge formed on the lid, which can be done by the user reaching with a knife or some other pointed object under the valve disk and pressing it upward.

To generate a vacuum in a food storage container, a device can be used to draw air out of the container. A wide variety of pumps for performing this function are known from the art. As a rule the pumps intended for household use are based on piston pumps or ventilators.

U.S. Pat. No. 5,195,427 discloses a prior-art electrically powered handheld vacuum pump for use in the household. The handheld device is constructed from a multiplicity of single parts for use solely as a vacuum pump. In particular, the shaft's rotary motion is elaborately converted into an oscillating motion. A suitable reduction gear drives the piston pump. The system is intended for the evacuation of food storage containers. With this device, it is possible to easily obtain a suitable pressure ratio for storing food in a vacuum container.

DE 195 04 638 A1 discloses an immersion blender for mixing or comminuting food. The blender includes a blade which rotates in a bell-shaped recess, thereby generating a vacuum. The vacuum that accumulates in the bell serves to improve and intensify the mixing of food.

In 299 20 316 U1, a device generates a vacuum in a container by using a vacuum-cleaner as a vacuum generator. An adapter piece in the form of an attachment to a vacuum-cleaner is mountable on a valve arranged on the container lid.

SUMMARY

In one aspect, the invention features a food storage container including a lid with a vent hole through it. The food storage container also includes a removable cover removably secured to the lid to cover the vent hole. The cover has an evacuation hole through it. The lid further includes a one-way air valve located between the vent hole and the evacuation hole. With the cover secured to the lid, the one-way air valve inhibits air flow into the container through the vent hole while allowing air flow out of the container via the vent hole and evacuation hole. With the cover removed, the one-way air valve allows bi-directional air flow through the vent hole. An outer surface of the cover has a smooth sealing area extending about the evacuation hole. The sealing area seals against a vacuum pump held against the cover over the evacuation hole to evacuate the container.

The food storage container of the invention can be easy and economical to manufacture. The construction of the food storage container can make it unnecessary to have to center the vacuum pump.

In some embodiments, the one-way air valve includes a sealing tab. An advantage to this is that an integrated component with few individual parts can be provided as a result. In other words, once the storage container is evacuated, sealing can take place automatically by the sealing tab being drawn against the vent hole in the container lid.

The one-way air valve can have a flapper valve.

In some cases, the cover has a driving element. One end of the driving element is connected to the one-way air valve (e.g., to the sealing tab), while another end of the driving element extends through the cover. This embodiment can provide a surprisingly simple design solution for opening the container lid with ease because to begin with the sealing tab can be lifted off the vent hole by pulling open the cover by way of the driving element. This can result in pressure equalization between the interior of the container and the surroundings. The container lid can now no longer be drawn by the vacuum in the interior of the storage container and can be lifted off it with ease.

In certain embodiments, the end of the driving element that extends through the cover has a rim that can come into contact with a surface of the cover when the cover is lifted away from the lid.

The food storage container can include a pressure indicator located in a recess defined by the lid. An advantage to this embodiment is that the evacuation operation can be simplified because the user can immediately see when a sufficient vacuum is attained inside the storage container. Integrating this feature in the food storage container can result in a multi-function component.

The pressure indicator can extend through an opening in the cover. The pressure indicator can include a dome-shaped membrane. An advantage to this is that the pressure indicator can be visually and haptically detectable. The visual impact of the membrane, which can be made of an elastomeric plastic material, for example, can be increased by designing it accordingly in a signal color. The membrane can have a tactile effect, which can enable even users with poor vision to determine the condition of pressure inside the storage container. This tactile effect can be achieved according to the degree by which the pressure indicator projects beyond, or disappears within, the outer contour of the cover under the corresponding pressure conditions.

The dome-shaped membrane can have a resilient layer disposed on an interior surface of the membrane. The dome-shaped membrane can include a spring element that causes the pressure indicator to snap back into its initial position in the presence of a predetermined pressure. An advantage of this is that the pressure indicator can thereby adopt an unmistakable signal position. When there is ambient pressure inside the storage container, the membrane of the pressure indicator can project distinctly outward. When a pre-defined pressure below atmospheric is attained inside the container, the membrane can "snap" inward. With the spring suitably selected, the membrane can be guaranteed to snap back into its initial position when a minimum pressure below atmospheric is exceeded inside the storage container. In other words, in some cases there are only two unmistakable positions of the pressure indicator: sufficient pressure below atmospheric inside the storage container (the pressure indicator is snapped in), and insufficient pressure below atmospheric or ambient pressure (the pressure indicator is in its initial position).

The spring element can be formed, for example, by selecting a suitable resilient plastic material for the membrane of the pressure indicator or by inserting a spring metal in the membrane of the pressure indicator.

In some cases, the pressure indicator includes a plastic resin that can maintain dimensional stability of the membrane over a temperature range of between about −40° C. and about 100° C. An advantage of this is that the storage container and its contents can be stored in a deep-freezer and then defrosted in a microwave oven. The vent hole can be opened by way of the cover when heating the food storage container in the microwave oven. Possible materials for the pressure indicator can be polypropylene and polyamide as well as any other temperature-resistant and taste-neutral plastic material.

In some embodiments, the lid and the cover are integrally joined to each other. In some cases, the lid is connected to the cover by a hinge (e.g., a film hinge). In this case the material of the lid and/or cover can be selected for sufficient stiffness, as well as necessary sealing properties. Advantages to this embodiment can be economy of manufacture as an injection molding, and ease of mounting on the storage container. Furthermore, it can be possible to manufacture the container lid and the cover as a joint injection molding. The sealing tab and the membrane of the pressure indicator can be made of an elastic elastomeric plastic or rubber material, which can then be inserted in the component made up of the container lid and the cover. The fact that the cover can be used not only to open the vent opening, but also to lift the entire container lid via the film hinge, is a further advantage.

In another aspect, the invention features a food storage container including a container body with a vent hole. The food storage container also includes a removable cover removably secured to the container body to cover the vent hole. The cover has an evacuation hole through it. A one-way air valve is disposed between the vent hole and evacuation hole. With the cover secured to the container body, the one-way air valve inhibits air flow into the container through the vent hole while allowing air flow out of the container via the vent hole and evacuation hole. With the cover removed from the container body, the one-way air valve allows bi-directional air flow through the vent hole. An outer surface of the cover has a smooth sealing area extending about the evacuation hole for sealing against a vacuum pump held against the cover over the evacuation hole to evacuate the container.

In another aspect, the invention features a method for evacuating a food storage container. The method includes attaching a vacuum pump attachment to a handheld electric appliance with an electric motor operable to drive a shaft, such that the shaft is mechanically coupled to a drive of the vacuum pump to pump air. The vacuum pump includes a housing with a rim about an air inlet. The method further includes coupling the vacuum pump to a food storage container. The food storage container includes a lid with a vent hole through it. The food storage container also includes a removable cover removably secured to the lid to cover the vent hole. The cover has an evacuation hole through it. The lid further includes a one-way air valve located between the vent hole and the evacuation hole. With the cover secured to the lid, the one-way air valve inhibits air flow into the container through the vent hole while allowing air flow out of the container via the vent hole and evacuation hole. With the cover removed, the one-way air valve allows bi-directional air flow through the vent hole. An outer surface of the cover has a smooth sealing area extending about the evacuation hole. The sealing area seals against a vacuum pump held against the cover over the evacuation hole to evacuate the container. The vacuum pump is coupled to the food storage container by placing the rim of the vacuum pump housing against an outer surface of the storage container, about the evacuation hole. The method further includes activating the vacuum pump to evacuate air from the container through the one-way valve, and then removing the vacuum pump from the container.

An advantage of this method is that it can be easy and quick to perform. The low requirements imposed on the user by the method can make it especially suitable for the household sector. In some cases, no elaborate centering is needed prior to the evacuation operation.

In some embodiments, the vacuum pump attachment is attached to the handheld electric appliance before the vacuum pump is activated. In some cases the handheld electric appliance is a motorized handle of an immersion blender, and the method includes, prior to attaching the vacuum pump attachment to the handheld electric appliance, removing a blending attachment from the motorized handle.

In another aspect, the invention features a storage container evacuation pump. The evacuation pump includes a handheld electric appliance having an electric motor operable to drive a shaft, and a pump attachment. The pump attachment has a vacuum pump housing with a sealing lip about an air inlet of the pump attachment. The pump attachment also has a pump element located within the vacuum pump housing. The pump attachment is releasably coupled to the appliance. The shaft of the appliance operably engages the pump element. The appliance is removable from the pump attachment for powering other attachments.

The pump attachment can provide a small, low-cost and easy-to-use vacuum pump for household applications. In some cases, there is no need for a completely new household appliance and equivalent additional storage space. The attachment can add a further useful component to already existing attachments such as mixers, blenders, etc. This can be a particularly space-saving solution, and far cheaper than an additional electric appliance with its own drive. Furthermore, the attachment can be easy and safe to use in the domestic field. The attachment can be a simple and economical solution. The attachment can simply be plugged into the handheld electrical appliance by, e.g., spur-toothed gears.

In some cases, the pump element has a rotor disposed within a ring (e.g., a graphite ring). The rotor can include vanes that are slidably disposed within slots of the rotor. This type of pump element can feature a higher suction power relative to other vacuum pumps used for domestic applications. The overall height of the pump element can be small because there may be no need of any elaborate rod mechanisms and gears. The pump element can be directly driven with the rotational frequency of the drive shaft of the household appliance. This can also reduce the number of components, which can have a positive effect in turn on the costs of manufacture. Finally, it can take just a few seconds with such a pump element to generate the required level of pressure in a food container.

The sealing lip can be a circumferential sealing, and can be suited for seating engagement with a connecting arrangement. The sealing lip can be formed by a circumferential edge of elastomeric plastic material. The cross-section of the sealing lip can widen toward its free end. This can make it easier for the attachment to be mounted on a suitable valve of a food storage container. The attachment may not need to be located centrally relative to a corresponding valve opening. The sealing lip can work like a suction cup.

In some cases, the attachment includes at its input end a plug-in shank adapted to be slid onto the conical output end of a household electrical appliance. The result can be a simple and low-cost plug-type connection with a handheld household appliance such as an immersion blender. This plug-type connection can be very sturdy and at the same time can serve as a centering arrangement for connecting the shaft couplings of the attachment and the household appliance.

The pump can further include a float section located between the pump element and the sealing lip and fluidly connected to the pump element by a suction pipe. The float section can include a float housing with a bar at one end for engaging a groove of the sealing lip, and defining suction slots at the end including the bar. A float is disposed within the float housing. The float housing can be adapted to limit the entry of liquid into the pump element.

This float section can provide an additional safety function by preventing liquid from entering the pump chamber during the evacuation operation. The solution can be simple and low-cost. For example, it can be possible to provide a simple spherical float in a riser, which floats on the liquid surface and closes a valve opening when the liquid has reached a predetermined level.

In some embodiments, the rotor further includes graphite fibers. Temperature resistance within the operating range can thereby be assured. In addition to this, the occurring centrifugal forces can be withstood without any deformations of unacceptable magnitude. This can also be promoted by the material-related light-weight construction.

In some cases, the vanes include graphite. In this arrangement, the vanes can be configured, for example, as rectangular plates that can be freely movable, actuated solely by centrifugal force, or exposed to spring pressure. By suitable material selection, a self-lubricating, maintenance-free construction can be made available.

In some embodiments, the attachment includes a thermoplastic (for example, polyethylene, polypropylene, or polyamide). This choice of material can represent a cheap, hygienic construction that can enable a multiplicity of designs.

The pump element can be a vane pump.

In some cases, the shaft of the appliance includes a first spur-toothed gear, and the first spur-toothed gear is releasably coupled to a second spur-toothed gear of the pump attachment.

Embodiments of the invention can include one or more of the following advantages.

The valve can allow a food storage container to be easily evacuated and subsequently reopened.

The vacuum pump of the attachment can be rendered temperature-resistant in its operating range. A self-lubricating effect can also be achieved thereby. The vacuum pump can display low pressure losses and/or require no maintenance.

The attachment can provide a small, low-cost and easy-to-use vacuum pump for household use. The attachment can prevent a user from having to purchase a new household appliance, and from having to procure additional storage space for the new appliance. Furthermore, the attachment can be relatively safe to use. The smooth outer walls of the immersion blender and the attachment (made of, e.g., thermoplastic material) can make it easy to clean the equipment combination.

The details of one or more embodiments of the invention are set forth in the accompanying drawings and the description below. Other features and advantages of the invention will be apparent from the description and drawings, and from the claims.

DETAILED DESCRIPTION

Figure 1:
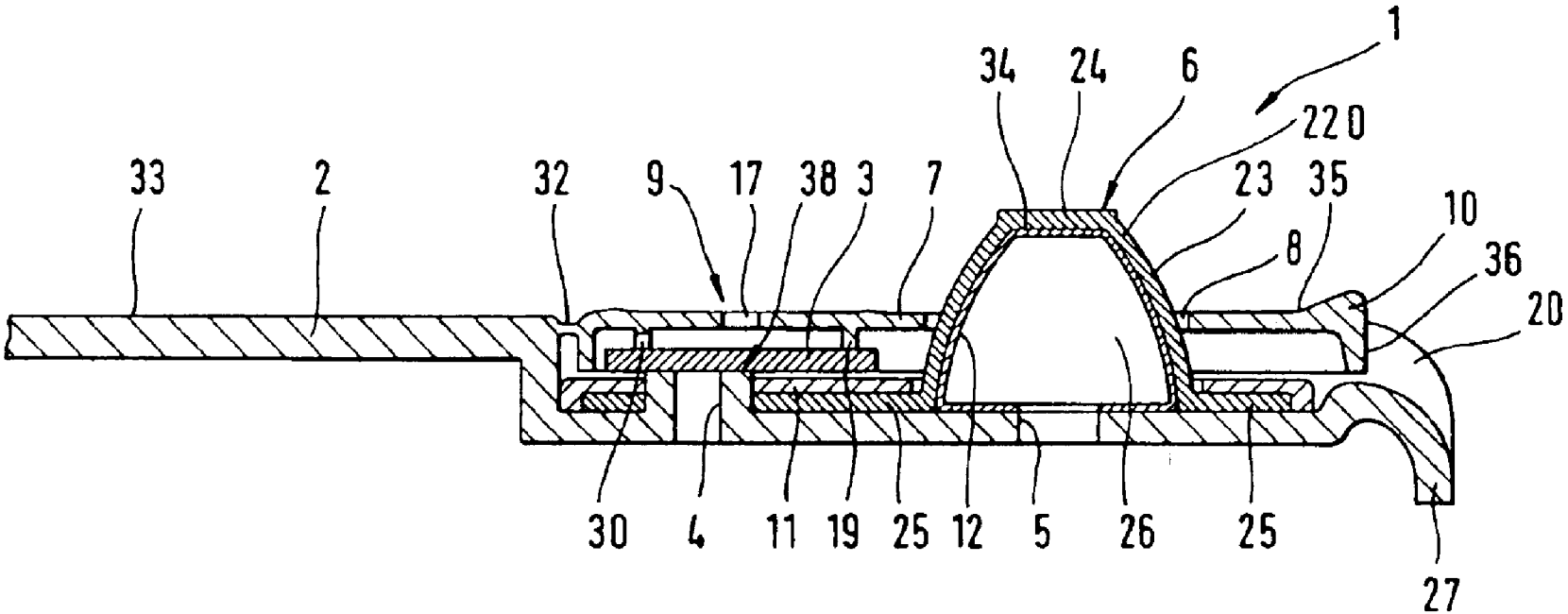
FIG. 1 is a schematic cross-sectional view of a first valve device for a food storage container when there is an insufficient vacuum inside of the container.
Figure 2:
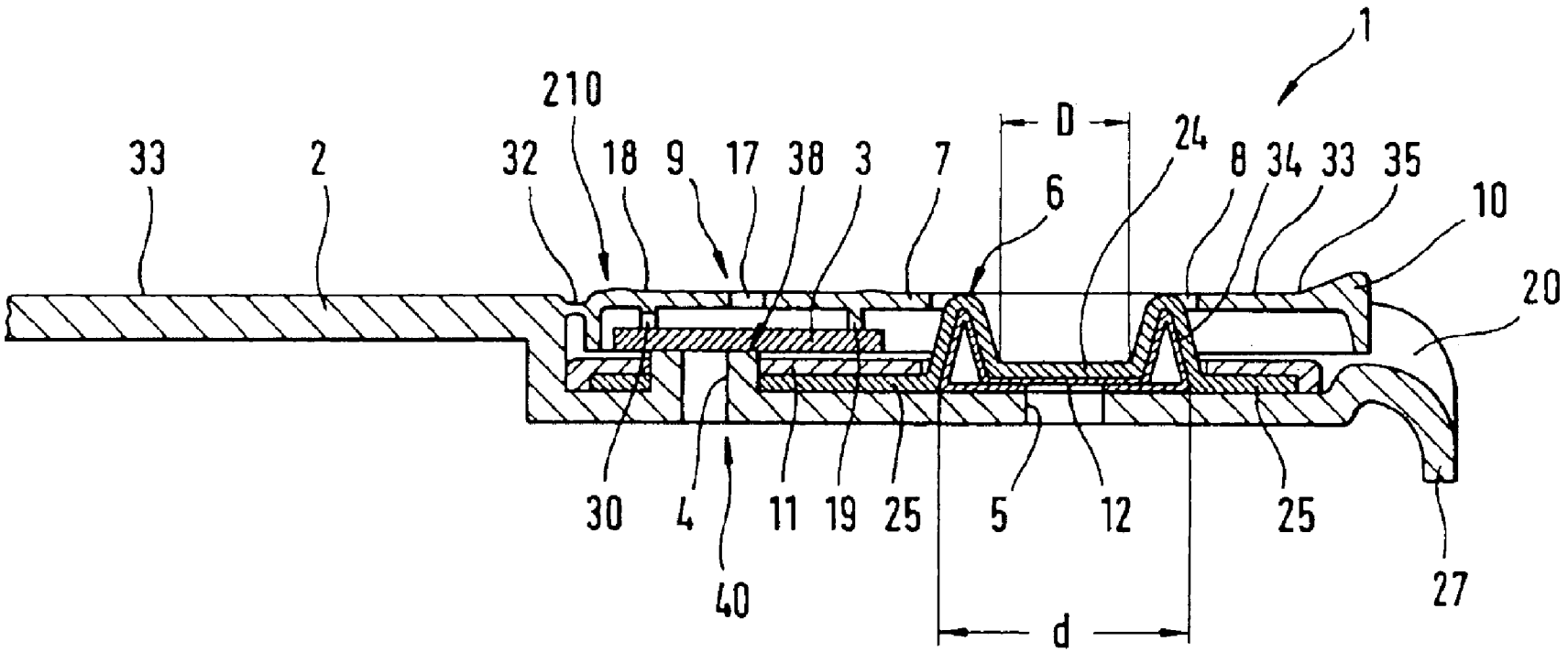
FIG. 2 is a schematic cross-sectional view of the valve device of FIG. 1, when there is a sufficient vacuum inside of the container.
Figure 3:
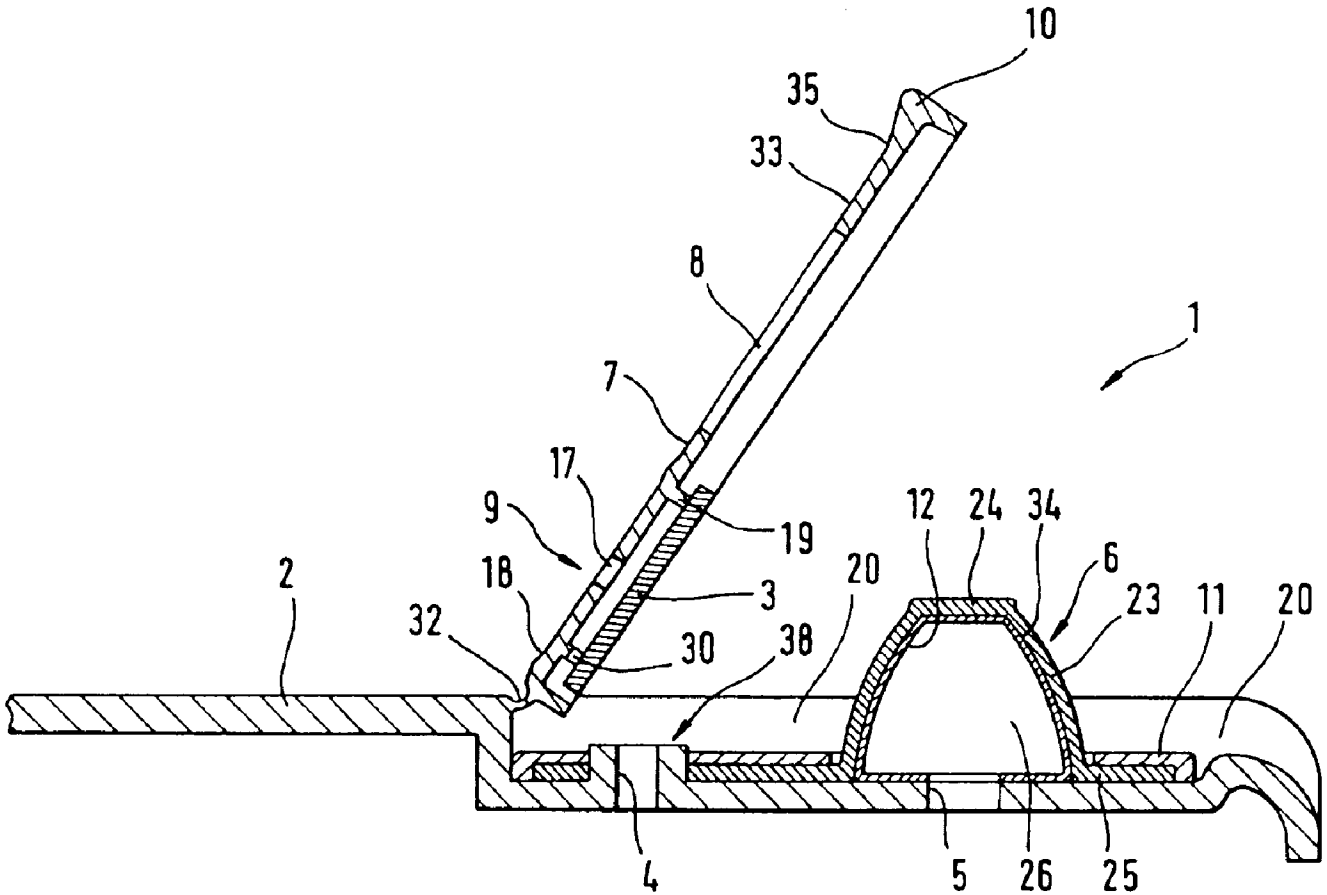
FIG. 3 is a schematic cross-sectional view of the valve device of FIG. 1, when the inside of the storage container is at atmospheric pressure.

Referring to FIGS. 1–3, a valve device 1, which is engageable with a food storage container 15, includes a pressure indicator 6.

Referring now to FIGS. 1–6, valve device 1 is mounted on a container lid 2. A cover 7 is integrally connected to container lid 2 by means of a hinge 32 (as shown, a film hinge). Cover 7 and container lid 2 are injection moldings made of a temperature-resistant thermoplastic material. Cover 7, which in the plan view can be in the form of an oval plate, includes a connecting device 9. Connecting device 9 allows container lid 2 to releasably engage a suction device such as a vacuum pump—e.g., connecting device 9 provides a suction port for a vacuum pump. Connecting device 9 is formed by a smooth annular surface 18 on the outer side 210 of cover 7, and by one or more evacuation holes 17 within annular surface 18. Surface 18 can have any of several configurations intended to provide a seal against a suction device pressed against the surface. A suitable connecting device is described in a U.S. patent application filed concurrently herewith, entitled "Food Storage Containers" and assigned Ser. No. 10/457,285, the entire contents of which are hereby incorporated by reference.

Preferably, the suction device will have a circumferential sealing lip, which acts like a suction cup, extending about its suction opening. For suction devices of this type, the suction surface of the sealing lip preferably has no structuring, thus enabling the suction power to be fully applied to evacuating the storage container. In addition, the evacuation hole or holes may have any cross-section within the smooth peripheral sealing region. The sealing surface may also extend in an undulating circle, the only provision being that the circumferential sealing lip of the suction device is then accordingly adapted in order to establish a tight connection.

In FIGS. 1–6, a sealing tab 3 (of, e.g., elastomeric plastic) is disposed on the lower side of cover 7, underneath connecting device 9.

In the valve device 1 shown in FIGS. 1–3, sealing tab 3 is fastened to cover 7 by a circular-ring-shaped bar 19, and is a separate component in the shape of a disk. Bar 19 includes an air passage 30.

In FIGS. 1–6, cover 7 is inserted in a recess 20 in container lid 2 of storage container 15. The recess is adapted to cover 7, and is essentially rectangular. A vent hole 4 is provided in container lid 2, under connecting device 9 of cover 7 and under sealing tab 3. When open, vent hole 4 provides a connection between the atmosphere and the interior 22 of storage container 15. When closed, vent hole 4 is closed air-tight by sealing tab 3. Vent hole 4 and sealing tab 3 together form a one-way valve 40 (e.g., a flapper valve), which closes in the direction of storage container 15.

Figure 4:
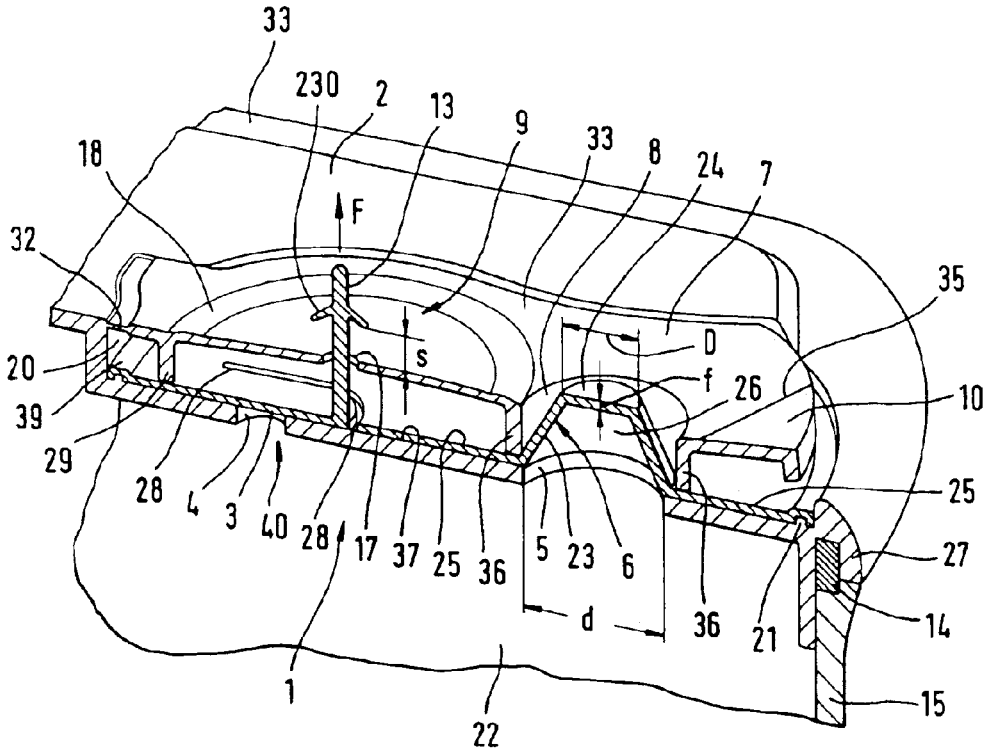
FIG. 4 is a perspective view, partially in cross-section, of a second valve device for a food storage container, when there is an insufficient vacuum inside of the container.

In FIGS. 1–6, a measurement opening 5 in container lid 2 is arranged adjacent to vent hole 4. Pressure indicator 6 includes a plastic membrane 220 which provides an air-tight covering for measurement opening 5. Pressure indicator 6 extends in an upward direction, essentially perpendicular to the plane of container lid 2. When there is an insufficient vacuum in the container, the entire pressure indicator projects upward relative to the plane of container lid 2. In other words, pressure indicator 6 displays an essentially cup-shaped, slightly outwardly domed side wall 23, which tapers in an upward direction and terminates with a horizontally extending circular top 24, as shown in FIGS. 1 and 3–5. Referring specifically to FIG. 4, top 24 has a diameter "D" which is smaller than the diameter "d" of the opening on base 25 of pressure indicator 6. As shown in FIG. 2, side wall 23 of pressure indicator 6 folds into a cavity 26 (FIG. 1) in the pressure indicator when exposed to vacuum.

Referring to FIGS. 1–6, cover 7 includes an indicator opening 8 at the position of pressure indicator 6. When the pressure in interior 22 of storage container 15 is not sufficiently below atmospheric pressure, pressure indicator 6 extends vertically out through indicator opening 8, past outer surface 33 of cover 7. Pressure indicator 6 can be made of an elastomeric plastic. Preferably, the pressure indicator is of an easily visible color (for example, the pressure indicator can be red to distinguish it from the surrounding material of the container lid, if the surrounding material is not red). In FIGS. 1–3, pressure indicator 6 is reinforced on its inner side by a layer 12 that preferably includes a resilient material, such as a spring sheet or elastomeric plastic. The surface of layer 12 is engaged with inner side 34 of pressure indicator 6.

In FIGS. 1–6, the section of cover 7 that is closest to the edge of storage container 15 has a gripping surface 10. For example, as shown in FIGS. 1–6, an end of cover 7 is beveled slightly upward starting at point 35, thereby forming gripping surface 10. Container lid 2 includes a recess 20 with a bottom 37. Cover 7 is separated from bottom 37 of recess 20 by ribs 29 and 36. Thus, gripping surface 10 of cover 7 can be comfortably gripped between the user's finger and thumb (not shown) and pulled open in an upward direction.

FIGS. 1–3 show a retaining clip 11 which presses the elastomeric plastic material of the planar base 25 of pressure indicator 6 against container lid 2. Retaining clip 11 is held in place by walls of the container lid recess (20). In FIGS. 1–3, cup-shaped pressure indicator 6 is integrally connected to base 25. Thus, when pressure indicator 6 is clamped by retaining clip 11, the pressure indicator effectively is sealed to container lid 2.

Figure 5:
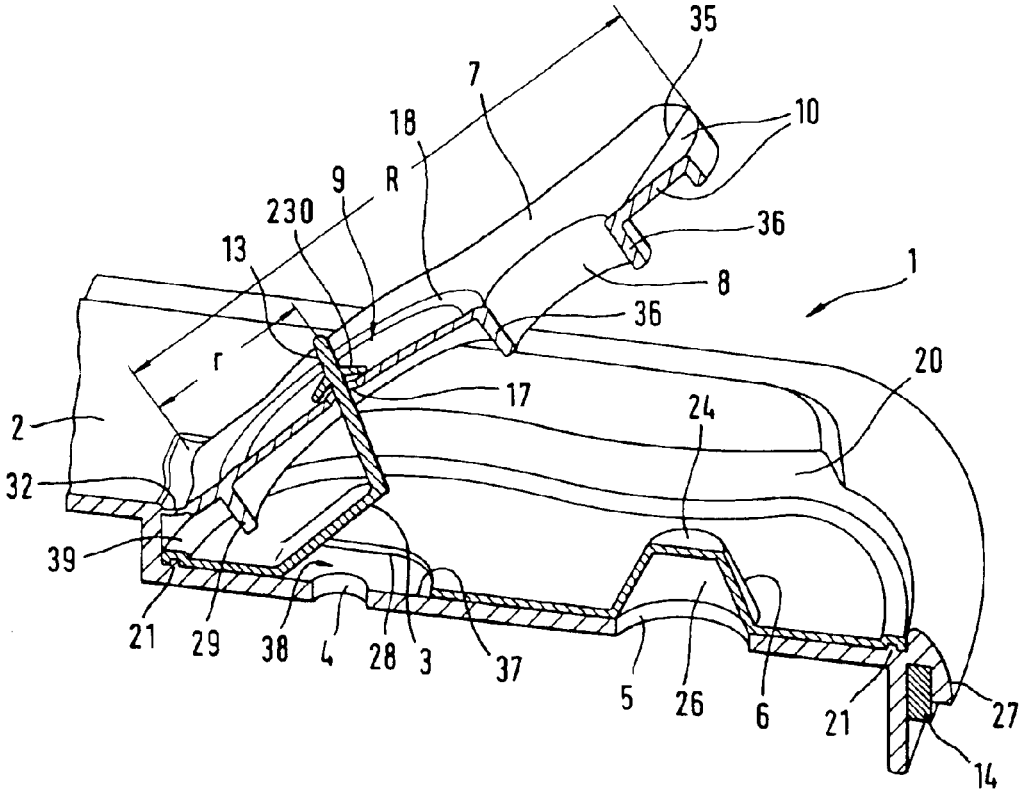
FIG. 5 is a perspective view, partially in cross-section, of the valve device of FIG. 4, when a vent has been opened in the storage container.
Figure 6:
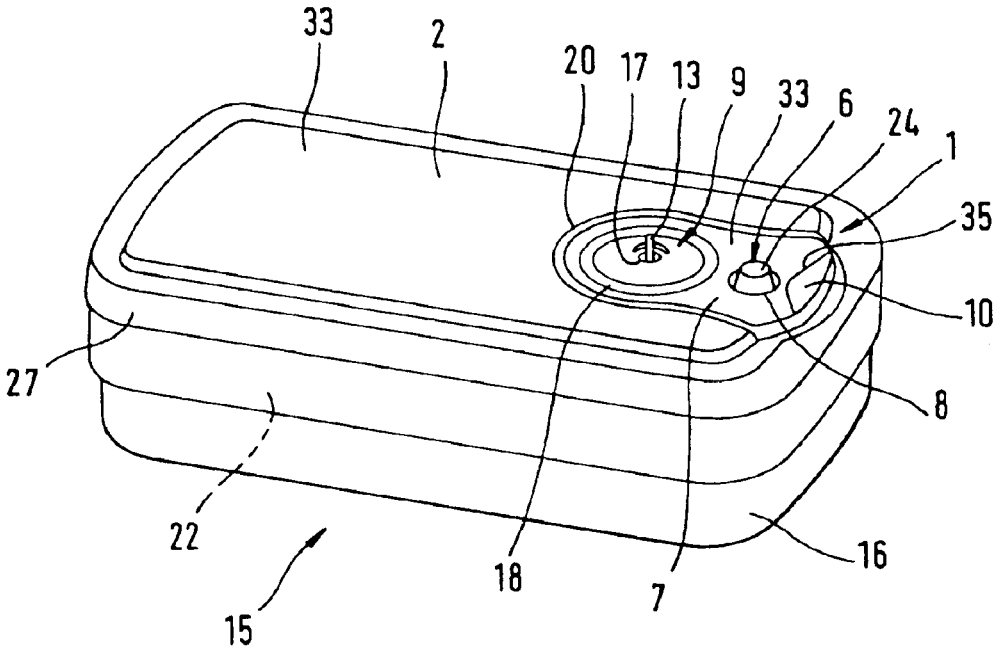
FIG. 6 is a perspective view of a food storage container including the valve device of FIG. 4.

Referring to FIGS. 4–6, a second example of a valve device 1 also includes a pressure indicator 6 for a food storage container 15. Cover 7 is again integrally connected to container lid 2 by means of a film hinge 32. Sealing tab 3 is arranged underneath connecting device 9 of cover 7. Sealing tab 3 is connected to cover 7 by a driving element 13. Sealing tab 3, driving element 13, base 25, and pressure indicator 6 all are made of a single elastomeric plastic part which is fastened as an insert to a bead 21 in recess 20 of container lid 2. The plastic material used for pressure indicator 6 has spring-like properties. Thus, the pressure indicator can snap into a position that indicates whether there is a sufficient vacuum inside the container.

When vacuum is applied to the valve device 1 of FIGS. 4–6, cover 7 is pressed by the vacuum pump against the base of sealing tab 3 and pressure indicator 6, thus producing a tight valve device and simultaneously rendering the pressure indicator well visible.

When vacuum is applied to the valve device 1 of FIGS. 1–3, cover 7 presses against sealing tab 3 to hold the sealing tab securely against container lid 2. Here, too, pressure indicator 6 is well visible.

There are some differences between the valve device 1 of FIGS. 1–3 and the valve device 1 of FIGS. 4–6. In FIGS. 1–3, sealing tab 3 forms a separate sealing part relative to pressure indicator 6. In the valve device of FIGS. 4–6, however, these parts are formed by a single elastomeric component—sealing tab 3 is partially cut out of base 25, thereby forming a gap 28. Furthermore, in FIGS. 4–5, a circumferential seal 14 is disposed around the edge of container lid 2. The seal enables the lid to be closed air-tight against the storage container 15. In FIGS. 1–3, on the other hand, lid 2 itself forms a tight closure with storage container 15 (i.e., there is no circumferential seal 14). When valve device 1 is closed, circumferential rib 29 presses base 25 against bottom 37 of recess 20, thus effecting a seal. Another difference between the valve device 1 of FIGS. 1–3 and the valve device 1 of FIGS. 4–6 is that the valve device shown in FIGS. 4–6 includes driving element 13, while the valve device shown in FIGS. 1–3 does not.

In FIGS. 1 and 3–6, the pressure in interior 22 of storage container 15 is equal to ambient pressure. Because of its spring bias, pressure indicator 6 thus projects out through indicator opening 8 and beyond cover 7.

In FIG. 2, there is sufficient vacuum in interior 22 of storage container 15. Pressure indicator 6 is thus drawn into its cavity 26, toward container interior 22. The pressure indicator is in a folded or snapped-in condition. In this state, pressure indicator 6 either does not project at all beyond the outer contour of cover 7, or else projects beyond the outer contour by a negligible amount. Pressure indicator 6 folds like a rolling membrane. The ratio of diameter "D" to diameter "d" is selected based on the wall thickness "f" and the elastic material of pressure indicator 6, so that the pressure indicator will abruptly fold together when there is a sufficient vacuum in the interior of the container (as shown in FIG. 2). If the vacuum in container interior 22 decreases, then at the point of insufficient vacuum, pressure indicator 6 will make an abrupt outward movement, snapping back into the position shown in FIGS. 1 and 3–6. Thus, the user has a clear indication of whether there is a sufficient vacuum in the container.

A user can first inform himself about the pressure status in container interior 22 by checking the position of pressure indicator 6 when container lid 2 is closed. If the bottom of pressure indicator 6 projects out through indicator opening 8, then the pressure in container interior 22 is insufficient for guaranteeing the storage of food under vacuum conditions (as is the case in FIGS. 1, 4, and 6).

In FIGS. 1, 3, and 6, storage container 15 is evacuated. To evacuate the container, a suction port with a circumferential sealing lip of a vacuum pump (not shown) is placed on connecting device 9 of valve device 1. Then, the vacuum pump is put into operation, causing vent hole 4 of valve device 1 to automatically open. Vent hole 4 opens because the suction effect causes sealing tab 3 to lift off from the vent hole, and the air contained in storage container 15 is drawn off by the vacuum pump. In FIG. 1, the air is drawn through vent hole 4, past the side of sealing seat 38 of sealing tab 3, around the outside of sealing tab 3, through air passage 30, and through connecting device 9 to the vacuum pump. As shown in FIG. 2, when a sufficient vacuum is attained in interior 22 of storage container 15, pressure indicator 6 suddenly snaps inward, thereby informing the user that he can end the evacuation operation. After the vacuum pump is disengaged from connecting device 9, sealing tab 3 is pressed against the edge of vent hole 4, automatically closing it air-tight. This operation also occurs with each return stroke of the vacuum pump, in order to enable a vacuum to be built up in interior 22. The vacuum in interior 22 keeps enclosed food fresh for a long time because lack of oxygen prevents the food from being oxidized.

To remove food from storage container 15, the user grips cover 7 with two fingers under gripping surface 10 and, with little force, swivels cover 7 in a counterclockwise direction (as shown in FIG. 5). Referring to FIG. 3, sealing tab 3 is thus lifted by cover 7 in an upward direction, off sealing seat 38, and vent hole 4 is cleared. In the valve device 1 shown in FIG. 5, the upper side of cover 7 first comes up against the lower side of a rim 230 (having, e.g., a generally conical shape) formed on driving element 13. The upper side of cover 7 then pulls driving element 13 and sealing tab 3 upward, until sealing tab 3 lifts off from sealing seat 38 and swivels upward in a counterclockwise direction. Referring to FIGS. 3 and 5, air can now flow into container interior 22 via vent hole 4.

Container lid 2 can now be removed from storage container 15 without any notable effort. In FIGS. 4–5, sealing tab 3, which is partially separated from the rest of planar base 25 by gap 28, and which is connected to base 25 only in area 39, repeatedly falls back onto vent hole 4 as a one-way valve acting under the force of gravity. Thus, it is relatively easy to produce a vacuum in the container. It also is conceivable, however, for cover 7 to be designed to snap into place by means of clip connectors on container lid 2, thereby enabling sealing tab 3 to close vent hole 4. Referring to FIG. 3, sealing tab 3 also is lifted when cover 7 is swiveled around film hinge 32 because the sealing tab is fastened with clearance to cover 7, in order to perform the function of a one-way valve.

Referring to FIG. 6, a thermoplastic food storage container 15 includes the valve device 1 of FIG. 4. Storage container 15 has a container body 16 in the shape of a right-parallelepiped and, when viewed from the top, has an essentially rectangular container lid 2 with a circumferential rim 27. Valve device 1 is arranged in a recess 20 on one of the narrow sides of container lid 2. Gripping surface 10 of cover 7 terminates approximately with outer surface 33 of container lid 2. When there is insufficient vacuum inside of the container, only pressure indicator 6 projects vertically out of indicator opening 8 of cover 7. Adjacent to pressure indicator 6 are connecting device 9 (which can be, for example, a circular connecting device), with smooth annular surface 18, and evacuation hole 17, from which driving element 13 projects with its rim 230. Rim 230 improves the driving effect of driving element 13 when cover 7 is swiveled upward. Through the leverage produced by distances "R" and "r" (shown in FIG. 5), relatively little manual force "F" (shown in FIG. 4) needs to be applied to grip surface 10 and lift sealing tab 3 from sealing seat 38, even when there is still a vacuum in interior 22 of the container. As distance "r" becomes smaller and distance "R" becomes larger, it becomes easier to open valve device 1.

Figure 7:
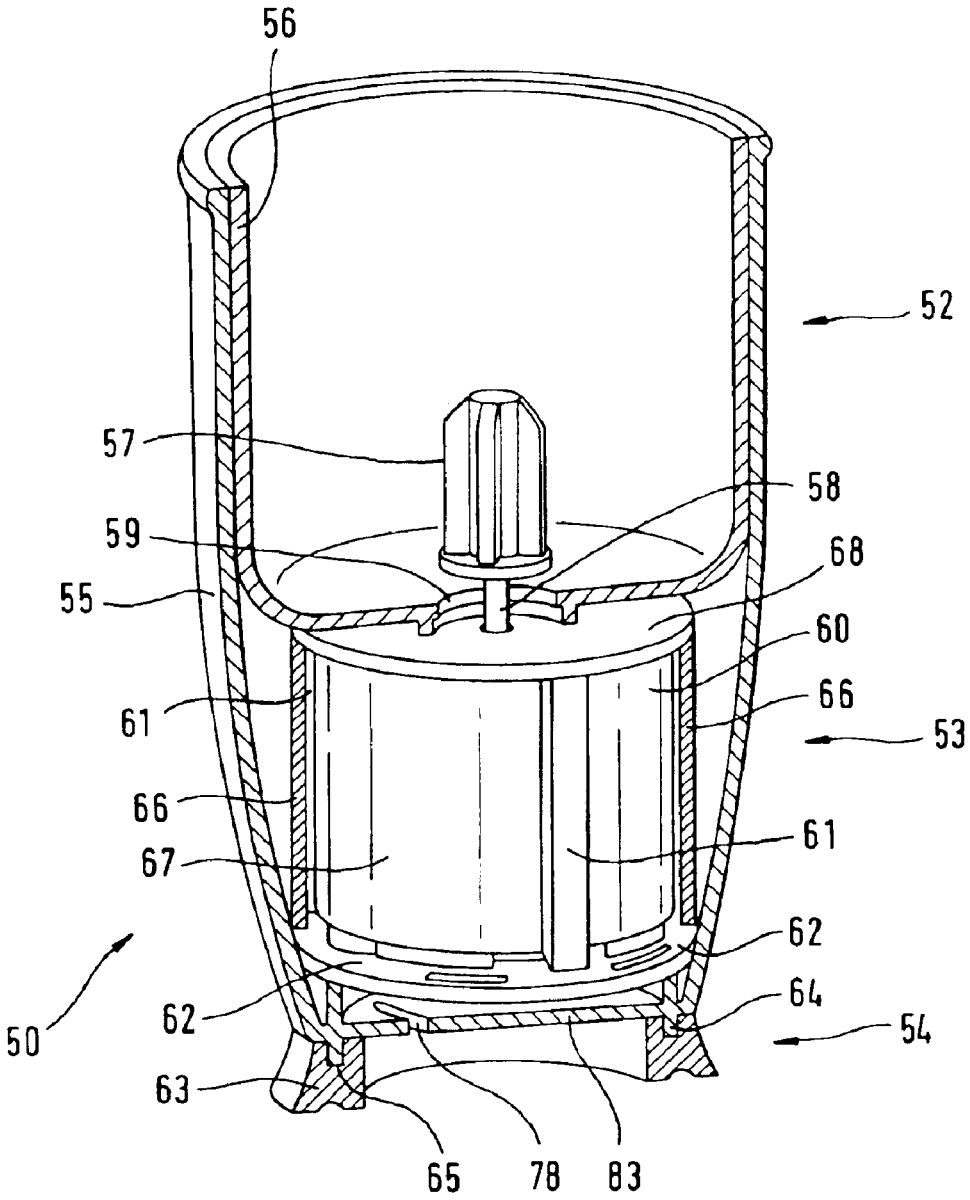
FIG. 7 is a schematic cross-sectional view of a device for evacuating a food storage container.
Figure 8:
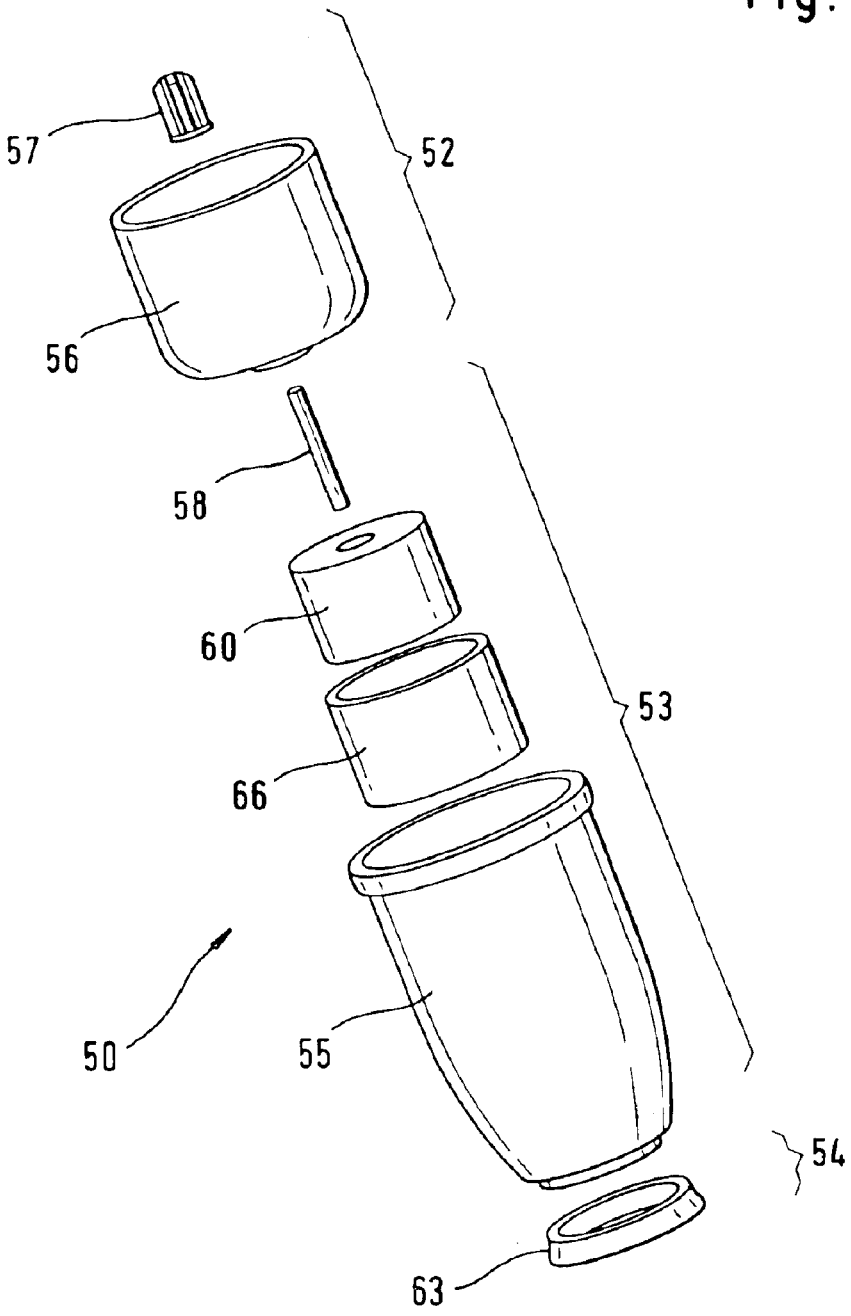
FIG. 8 is an exploded perspective view of the device of FIG. 7.

Referring now to FIGS. 7 and 8, an attachment 50 includes an attachment housing 55 with a coupling section 52 and a pump section 53. Attachment 50 also has a suction section 54. The coupling section is formed by a cup-shaped plug-in shank 56, within which is disposed a coupling gear 57. In the base area of the plug-in shank is a base opening 59, through which a shaft 58 passes. The shaft is connected to coupling gear 57. Disposed within pump section 53 is a vacuum pump 67.

Figure 9:
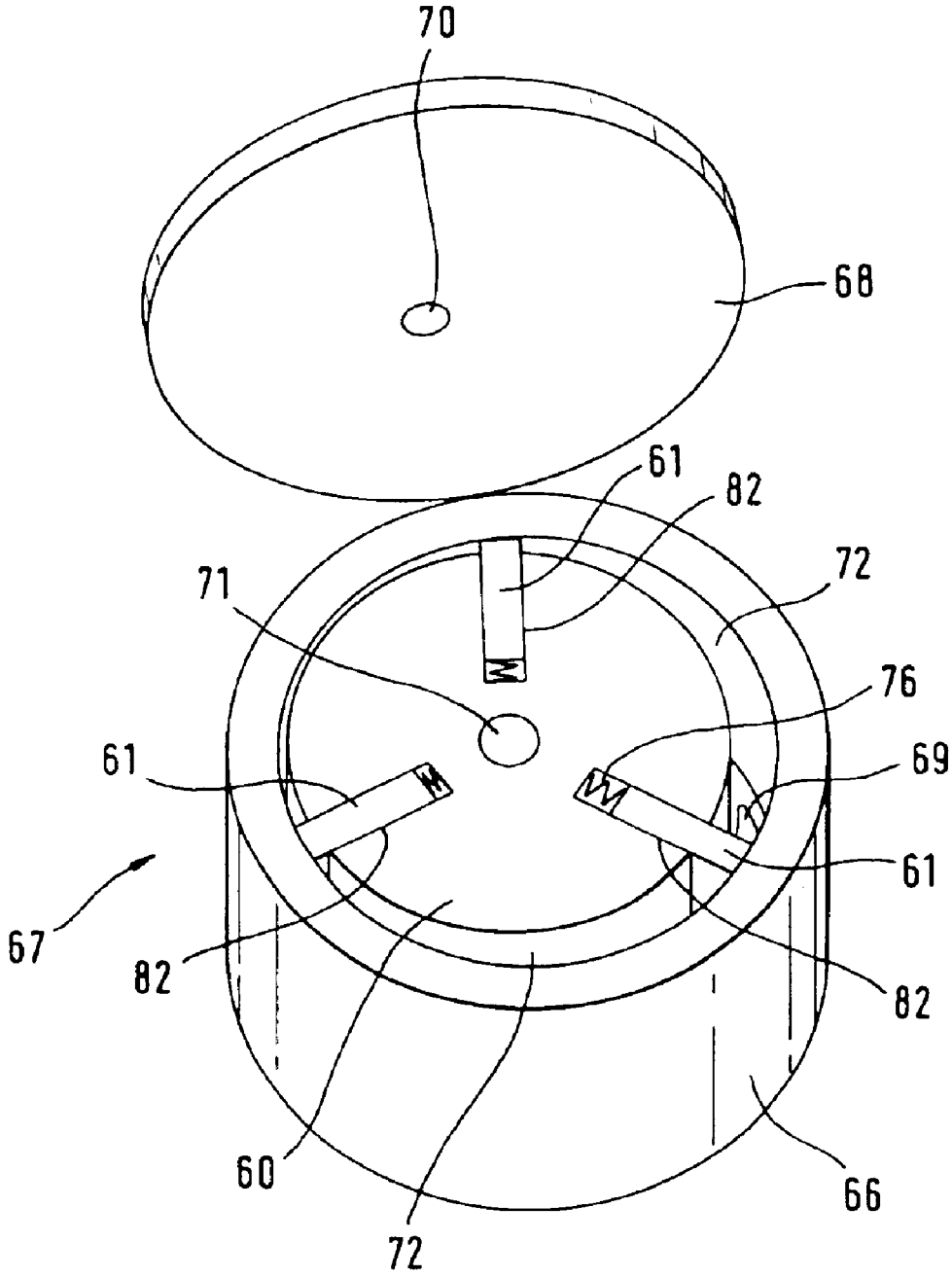
FIG. 9 is a perspective view of a portion of the device of FIG. 7.

As shown in FIGS. 7 and 9, vacuum pump 67 is a vane-type pump. Referring now to FIGS. 7–9, the housing of the vane-type pump is formed by a ring 66 (e.g., a graphite ring), which is covered at its upper and lower ends by a circular upper end disk 68 and a lower end disk 62, respectively. A cylindrical rotor 60 is eccentrically mounted for rotation in the pump housing. Rotor 60 has an arrangement of uniformly distributed radial slots 82, within which radially displaceable vanes 61. Vanes 61 are pressed against graphite cylinder 66 by centrifugal force, supported by the force of springs 76. The result is the formation of fluid-delivery cells 72, which together form a crescent-shaped configuration.

As FIG. 7 shows, rotor 60 is connected to shaft 58. At one of its ends, shaft 58 passes through upper end disk 68. The end of the shaft which projects out of the upper end disk has a coupling gear 57, which is constructed as a spur-toothed gear. Furthermore, in coupling section 52, an annular sheath continues along the wall of housing 55. This shaft-side housing end of attachment 50, which is constructed as a plug-in shank 56, is adapted to be connected to the tool-side end of an immersion blender.

Referring now to FIGS. 7 and 8, around the other circumference of the other end of housing 55 is a circumferential sealing lip 63 made of an elastic rubber material. The sealing lip has a groove 65, which allows it to connect to a bar 64 on housing 55. Sealing lip 63 is constructed to act as a kind of suction cup when in operation. Housing 55 includes a cover 83, which has suction slots 78, fitted to the end of the housing that engages the sealing lip. The suction slots lie within the section of cover 83 that is surrounded by annular sealing lip 63.

Referring now to FIG. 9, vacuum pump 67 includes upper end disk 68 (shown in the opened position) which, like graphite cylinder 66 and lower end disk 62, is made of graphite. A bore 70 is eccentrically located in circular upper end disk 68, and acts as the shaft bearing of rotor shaft 58 (not shown here). Bore 70 is constructed as a self-lubricating plain bearing. Rotor 60, carried by shaft 58, is arranged within graphite cylinder 66 which, together with upper end disk 68 and lower end disk 62, forms the pump housing of vacuum pump 67.

Carbon-fiber rotor 60 is arranged eccentrically relative to the center of graphite cylinder 66. The rotor has three slots 82 arranged at an angular offset of 120° to each other, in which vanes 61 are guided, such as to be longitudinally displaceable in the radial direction. The vanes are fabricated essentially as rectangular graphite plates.

Rotor 60 includes a shaft bore 71. At the ends of the vanes that face shaft bore 71, the vanes are acted upon by the pressure of compression springs 76. Suction opening 69 is arranged on lower end disk 62, and provides a way for air to be drawn out of a storage container. Fluid-delivery cells 72 are formed by rotor 60, upper end disk 68, lower end disk 62, graphite cylinder 66, and vanes 61.

Figure 10:
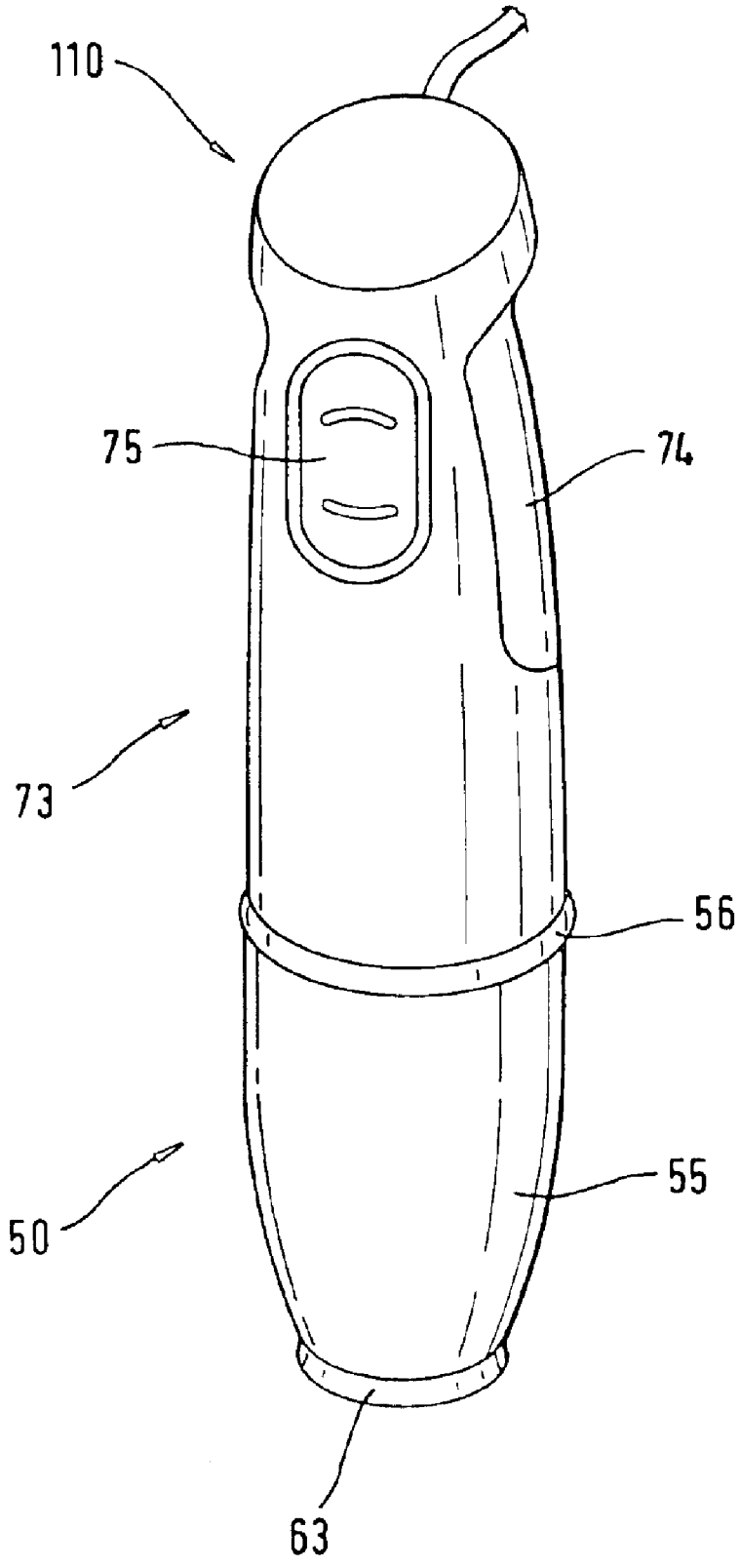
FIG. 10 is a perspective view of an immersion blender with an attachment.

When vacuum pump 67 is in operation, the rotor turns with the shaft speed of the immersion blender to which attachment 50 is attached (such as immersion blender 73, shown in FIG. 10). As the result of centrifugal force and spring force, vanes 61 slide along the inner wall of the graphite ring, hence guaranteeing that pressure compensation does not occur between the various fluid-delivery cells.

In FIG. 10, attachment 50 is mounted on the output end of immersion blender 73, forming a vacuum pump unit 110. The essentially elongated cylindrical equipment combination has at its upper end a grip 74 which can be gripped all-round by a user's hand. On the front side of the immersion blender, in its upper region, is an actuating switch 75, which is easy to operate with the gripping hand.

In the arrangement of FIG. 10, the upper region of attachment housing 55, which is constructed as plug-in shank 56, couples with the slightly conical output end of immersion blender 73. As this occurs, the shaft connection for driving the vacuum pump is simultaneously established.

During operation, attachment 50 is connected to the output end of immersion blender 73. The attachment is held by the annular sheath at the output end of the immersion blender, such that it cannot tilt or twist. The output shaft of the immersion blender is in positive engagement with coupling gear 57 of vacuum pump 67. The suction side of attachment 50 sits on a valve device on a food storage container, such as the valve devices 1 and food storage container 15 described above with reference to FIGS. 1–6 (see also FIG. 12). Circumferential sealing lip 63 (made of, e.g., elastomeric plastic) is arranged on the lower end of attachment 50, and forms a tight suction connection with, e.g., smooth annular surface 18 of cover 7 of valve device 1. While the storage container is being evacuated, rotor 60 of attachment 50 is set in rotation by the drive shaft of immersion blender 73.

Figure 11:
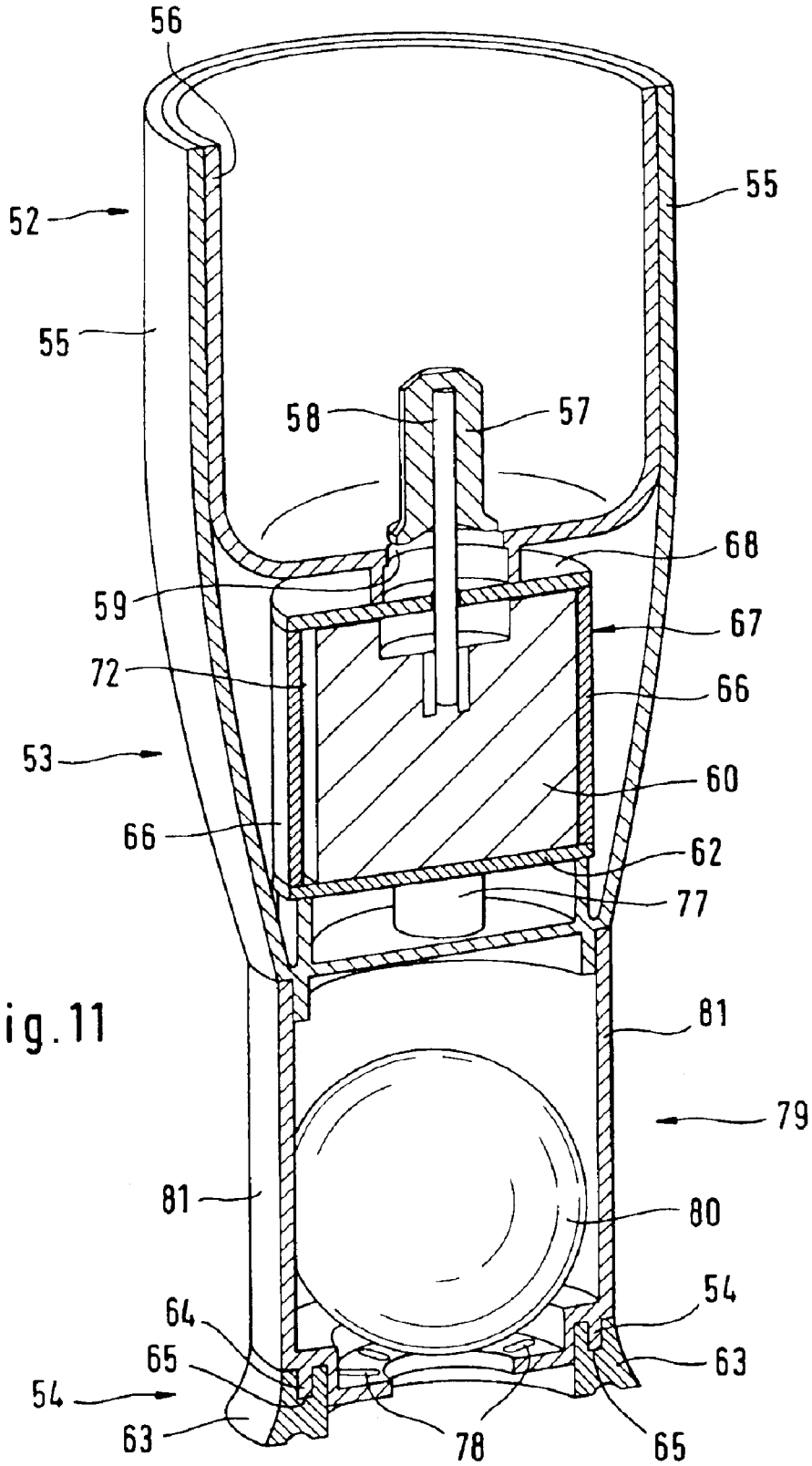
FIG. 11 is a schematic cross-sectional view of another device for evacuating a food storage container.

Referring to FIG. 11, a second example of attachment 50 further includes a float section 79, which prevents liquid from entering vacuum pump 67. The configurations of coupling section 52 and pump section 53 are essentially the same as they are in the attachment described in FIGS. 7–10.

In the attachment 50 shown in FIG. 11, float section 79 adjoins pump section 53. The float section is essentially formed by a cylindrical float housing 81 made of thermoplastic material. At its lower end, the float housing includes bar 64, which engages groove 65 of sealing lip 63, thereby forming suction port 54.

A spherical float 80 is provided in float housing 81. The float is hollow so that it easily floats on inflowing liquid. When the level of liquid in float housing 80 reaches a critical value, the lower opening of a suction pipe 77 is closed by the float. Liquid cannot then enter into vacuum pump 67. Additional suction slots 78 at the lower end of float housing 81 help to ensure that the air existing in a food storage container is evacuated.

Figure 12:
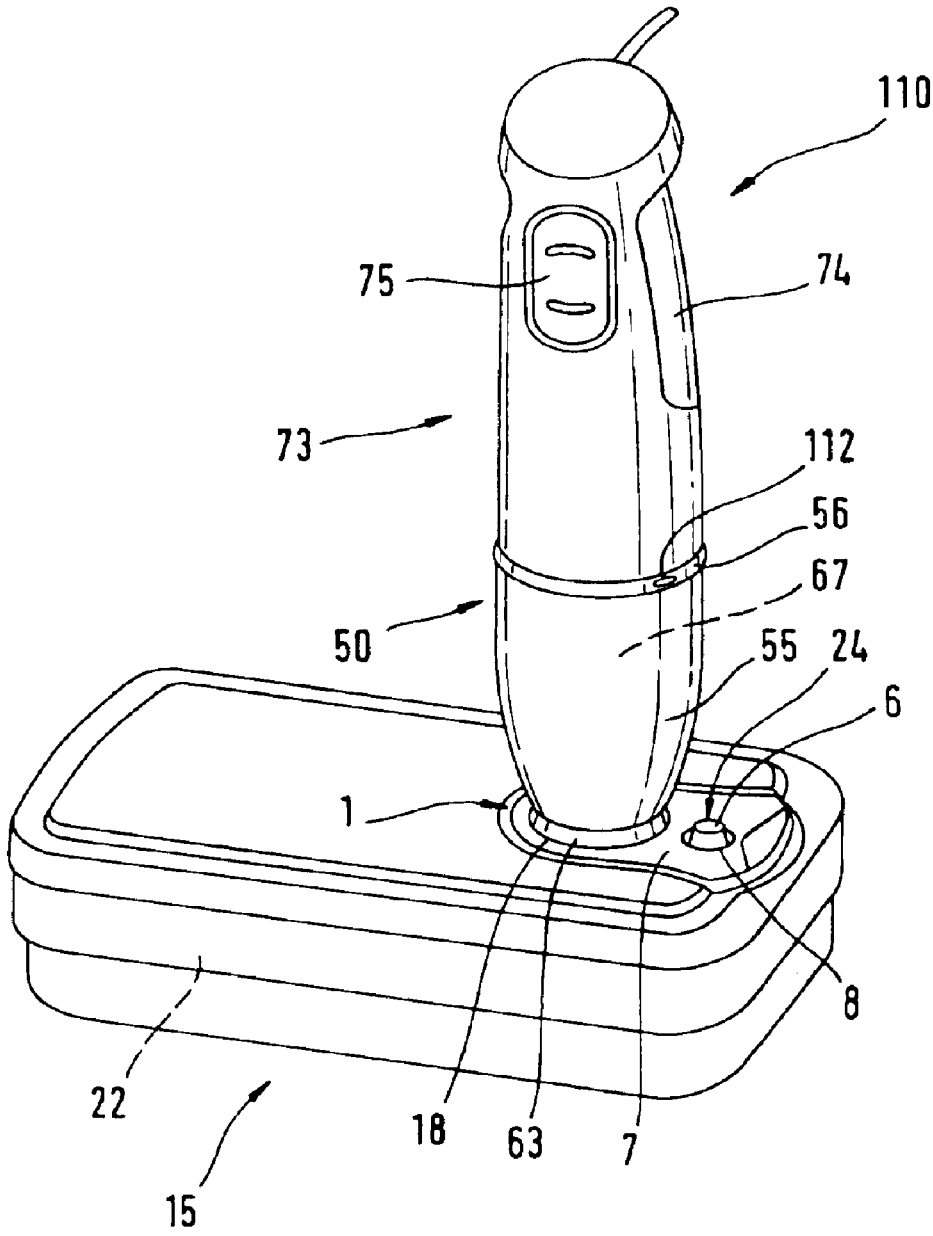
FIG. 12 is a perspective view of the immersion blender and attachment shown in FIG. 10, connected to the valve device of FIGS. 1–3.

Referring now to FIG. 12, immersion blender 73 is coupled with attachment 50, which has been flanged. The combination of the immersion blender with the attachment forms vacuum pump unit 110. To apply a vacuum to food storage container 15, vacuum pump unit 110 is manually pressed against annular surface 18 of cover 7 of valve device 1, thereby establishing a pressure-tight connection between container interior 22 and vacuum pump 67. In a pressure-free state, before vacuum pump 67 is activated, pressure indicator 6 has a convex configuration and projects outward from indicator opening 8 of cover 7.

After opening valve device 1, the air from storage container 15 is delivered outward to the atmosphere via suction slot 78, base opening 59, and a slot 112 arranged at plug-in shank 56. Once the required vacuum has been obtained in container interior 22, circular top 24 and domed side wall 23 of pressure indicator 6 move toward container interior 22. At this point, the pressure indicator is hardly visible from the outside, since it has withdrawn into indicator opening 8. A user now knows that an adequate vacuum has been applied to the storage container. Actuating switch 75 can, therefore, be manually switched off, thus bringing vacuum pump unit 110 to a standstill. The vacuum pump unit can be lifted off container lid 2 manually. When this occurs, valve device 1 shuts and the storage container is now closed in a pressure-tight manner.

If a user later wishes to open storage container 15, then the storage container must first be evacuated by opening valve device 1. To do so, the user can press downward against gripping surface 10 of cover 7, such that cover 7 is tilted upward. Thereby, the valve device gets into its open position, and air from the atmosphere can enter the storage container via the valve device. At this point, the container lid can be lifted from the container body with little effort.

A number of embodiments of the invention have been described. Nevertheless, it will be understood that various modifications may be made without departing from the spirit and scope of the invention. Accordingly, other embodiments are within the scope of the following claims.

What is claimed is:

1. A storage container evacuation pump comprising:

a handheld electric appliance comprising an electric motor operable to drive a shaft; and a pump attachment comprising:

a vacuum pump housing with a sealing lip about an air inlet of the pump attachment, and a pump element disposed within the vacuum pump housing and comprising a rotor disposed within a ring and having vanes slidably disposed within slots of the rotor, wherein the pump attachment is releasably coupled to the appliance with the shaft of the appliance operably engaging the pump element, the appliance being removable from the pump attachment for powering other attachments.

2. The pump of claim 1, wherein the ring comprises graphite.

3. The pump of claim 1, further comprising a float section disposed between the pump element and the sealing lip and fluidly connected to the pump element by a suction pipe, the float section comprising:

a float housing including a bar at one end for engaging a groove of the sealing lip, and defining suction slots at the end including the bar; and a float disposed within the float housing, wherein the float housing is adapted to limit the entry of liquid into the pump element.

4. The pump of claim 1, wherein the rotor further comprises graphite fibers.

5. The pump of claim 1, wherein the vanes comprise graphite.

6. The pump of claim 1, wherein the pump element comprises a vane pump.

7. The pump of claim 1, wherein the shaft of the appliance comprises a first spur-toothed gear, and wherein the first spur-toothed gear is releasably coupled to a second spur-toothed gear of the pump attachment.

8. The pump of claim 1, wherein the attachment further comprises a thermoplastic.

9. The pump of claim 8, wherein the thermoplastic is selected from the group consisting of polyethylene, polypropylene, and polyamide.

10. A storage container evacuation pump comprising:

a handheld electric appliance comprising an electric motor operable to drive a shaft;

a pump attachment comprising:

a vacuum pump housing with a sealing lip about an air inlet of the pump attachment, and a pump element disposed within the vacuum pump housing; and a float section disposed between the pump element and the sealing lip and fluidly connected to the pump element by a suction pipe, the float section comprising:

a float housing including a bar at one end for engaging a groove of the sealing lip, and defining suction slots at the end including the bar; and a float disposed within the float housing, wherein the float housing is adapted to limit the entry of liquid into the pump element, and the pump attachment is releasably coupled to the appliance with the shaft of the appliance operably engaging the pump element, the appliance being removable from the pump attachment for powering other attachments.

11. The pump of claim 10, wherein the pump element comprises a rotor disposed within a ring comprising graphite and having vanes slidably disposed within slots of the rotor.

12. The pump of claim 10, wherein the pump element comprises a rotor disposed within a ring, the rotor comprising graphite fibers and having vanes slidably disposed within slots of the rotor.

13. The pump of claim 10, wherein the pump element comprises a rotor disposed within a ring and having vanes comprising graphite, the vanes being slidably disposed within slots of the rotor.

14. The pump of claim 10, wherein the pump element comprises a vane pump.

15. The pump of claim 10, wherein the shaft of the appliance comprises a first spur-toothed gear, and wherein the first spur-toothed gear is releasably coupled to a second spur-toothed gear of the pump attachment.

16. The pump of claim 10, wherein the attachment further comprises a thermoplastic.

17. The pump of claim 16, wherein the thermoplastic is selected from the group consisting of polyethylene, polypropylene, and polyamide.

* * * * *